US006670084B2

(12) United States Patent
Friedman et al.

(10) Patent No.: US 6,670,084 B2
(45) Date of Patent: Dec. 30, 2003

(54) IMAGED PRINTING PLATE AND METHOD OF PREPARATION

(75) Inventors: Patrick R. Friedman, Bridgewater, NJ (US); Dominique LaPorte, Foulayronnes (FR); Patrice Aurenty, Paris (FR)

(73) Assignee: Kodak Polychrome Graphics LLC, Norwalk, CT (US)

( * ) Notice: Subject to any disclaimer, the term of this patent is extended or adjusted under 35 U.S.C. 154(b) by 0 days.

(21) Appl. No.: 10/067,388

(22) Filed: Feb. 5, 2002

(65) Prior Publication Data

US 2003/0157417 A1 Aug. 21, 2003

(51) Int. Cl.[7] ..... G03G 13/26

(52) U.S. Cl. ..... 430/49; 101/457; 101/467; 101/470

(58) Field of Search ..... 430/49; 101/124, 101/467, 465, 457

(56) References Cited

U.S. PATENT DOCUMENTS

| | | | | |
|---|---|---|---|---|
| 3,315,600 A | | 4/1967 | Tomanek et al. | 101/149 |
| 4,271,249 A | | 6/1981 | Gilliams et al. | 430/101 |
| 4,444,858 A | | 4/1984 | Nishibu et al. | 430/49 |
| 4,457,992 A | | 7/1984 | Bhattacharjee et al. | 430/49 |
| 4,897,329 A | * | 1/1990 | Nakayama | 430/49 |
| 5,368,974 A | | 11/1994 | Walls et al. | 430/156 |
| 5,714,993 A | | 2/1998 | Keoshkerian et al. | 347/95 |
| 6,014,929 A | | 1/2000 | Teng | 101/456 |
| 6,025,100 A | | 2/2000 | Verschueren et al. | 430/49 |
| 6,105,500 A | | 8/2000 | Bhambra et al. | 101/455 |
| 6,376,140 B1 | * | 4/2002 | Friedman et al. | 430/49 |

FOREIGN PATENT DOCUMENTS

| | | |
|---|---|---|
| EP | 0898205 | 2/1999 |
| EP | 0901045 | 3/1999 |

* cited by examiner

*Primary Examiner*—John Goodrow
(74) *Attorney, Agent, or Firm*—Faegre & Benson LLP

(57) ABSTRACT

A printing plate useful in lithographic printing is prepared by a process comprising:

(a) applying a coating composition comprising at least one polymer such as polyethylene glycol to a substrate surface to provide the surface with a water-soluble or water-dispersible polymer coating;

(b) imaging the coated substrate with a toner composition comprising toner particles by imagewise applying the toner composition to the polymer coating, wherein the polymer coating has a softening temperature $T_S$;

(c) heating the imaged substrate to a temperature $T_F$ which is equal to or greater than $T_S$; and (d) contacting the imaged substrate with a solution capable of removing the non-imaged portion of the polymer coating, wherein the process does not comprise a chemical development step and the polymer coating has a coating weight of about 0.25 to about 2.0 $g/m^2$.

30 Claims, 1 Drawing Sheet

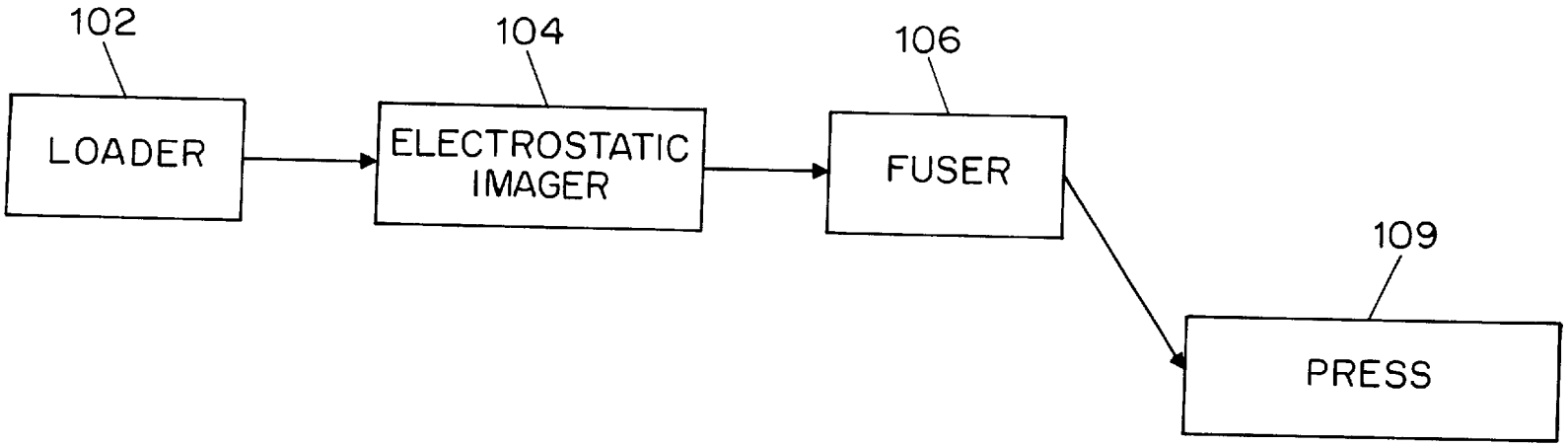
FIG. 1
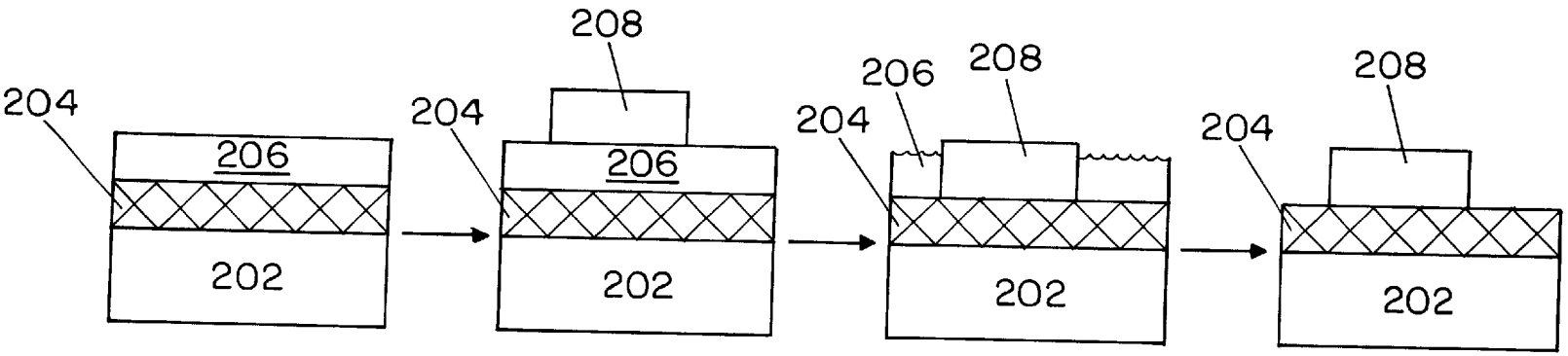
FIG. 2A
FIG. 2B
FIG. 2C
FIG. 2D

IMAGED PRINTING PLATE AND METHOD OF PREPARATION

BACKGROUND OF THE INVENTION

1. Field of the Invention

This invention relates to printing plates, which are imaged by imagewise application of toner to a receiving layer, to methods of preparing such printing plates, and to methods of printing using such printing plates. More particularly, the printing plates of this invention are prepared by applying a composition comprising a water-soluble or water-dispersible polymer to a substrate surface to provide the surface with a polymer coating. The coated substrate is electrostatically imaged using a toner composition which is applied to the polymer coating, and the imaged substrate is heated to fuse the toner composition to the substrate polymer coating. The toner functions as an oleophilic, ink accepting image area and the non-imaged areas function as hydrophilic, water-accepting ink repellant background areas. The imaged plate is thereafter contacted with an appropriate solution to remove the non-imaged portion of the polymer coating which is unprotected by the fused toner composition, without the need for a chemical development step.

2. Background Information

The manufacture of printing plates, including printing plates used in lithographic printing processes, using electrostatic imaging techniques is well known in the art. In such methods, the fixed toner images are the olephilic ink receptive portions of the plate, and upon contact of the plate with an appropriate ink or ink-containing solution, the desired ink image may be transferred, or "offset," from the plate to an appropriate medium, such as a rubber blanket, which is then used to print onto a medium such as paper. Examples of methods of preparing printing plates which are electrostatically imaged include:

U.S. Pat. No. 3,315,600, which discloses a method for preparing a printing plate in which a support having a hydrophilic surface is provided with a covering layer, the covering layer is electrostatically imaged using a toner composition, the image is fused or fixed via heating, and the covering layer is removed from the non-imaged areas by means of an aqueous solution. There is no disclosure regarding the thickness of the coverage layer.

U.S. Pat. No. 4,444,858, which discloses a method of preparing a lithographic printing plate in which a metal substrate is coated with a synthetic resin layer, and a toner image formed on a photosensitive sheet by an electrophotographic process is transferred and fixed to the synthetic resin layer. An organic solvent is used to remove the non-imaged areas of the resin layer, which are not covered by the fixed toner image.

U.S. Pat. No. 4,457,992, which discloses an etchable electrophotographic printing plate comprising an electroconductive support coated with a light-sensitive photoconductive zinc oxide and a sensitizing dye dispersed in an organic resin binder. Such plates are typically referred to as "organic photoconductor" or "OPC" plates. The coating is applied to the substrate as a thin film (i.e. about 5–50 $\mu$m), and dried to remove substantially all of the solvent. The resulting plate may be imaged with electrostatic toner, and the non-imaged portions of the coating are removed via a basic aqueous solution. The plate may thereafter optionally be heated to enhance plate endurance. The toner-receiving, polymeric coating of the present invention is not photoconductive.

U.S. Pat. No. 6,025,100, which discloses a printing plate prepared by transferring a toner image to an image receiving element which is a support having an image receiving layer thereon. The layer contains a hydrophilic binder, $TiO_2$ particles, and a matting agent, and the layer is cross-linked with hydrolyzed tetramethyl silicate or hydrolyzed tetraethylsilicate, thereby serving as the non-image area.

U.S. Pat. No. 6,014,929, which discloses a lithographic plate having a rough substrate and a releasable interlayer applied to the rough substrate surface. A radiation-sensitive layer may be applied to the interlayer. Alternatively, image-forming material may be imagewise transferred to the interlayer by an electrostatic process. The average coverage of the interlayer lies in the range of 0.001 to 0.2 g/m$^2$, preferably 0.004 to 0.04 g/m$^2$.

U.S. patent application Ser. No. 09/706,521 is directed to a printing plate prepared by applying an alkali soluble composition comprising at least one polymer to a hydrophilic substrate surface, imaging the coated substrate electrostatically with a toner composition, heating the imaged substrate to a temperature greater than the glass transition temperature of the toner, removing the portions of alkali soluble polymer which are not protected by the toner, and heating the imaged substrate to a temperature greater than the glass transition temperature of the toner a second time.

Electrostatically imaged printing plates are known to have several disadvantages. For example, if the underlying substrate is initially treated to be hydrophilic, it is often difficult to preserve the initial hydrophilic treatment of the substrate due to subsequent handling of the substrate and various factors which contribute to degradation of the hydrophilic surface such as fingerprints, scratches, presence of contaminants, and oxidation.

Another problem associated with electrostatically imaged printing plates is that the toner composition used typically yields inherently poor quality of the electrostatic image. The toner composition is composed of individual toner particles which are melted upon the intended substrate. If the substrate is untreated, the toner-imaged plate often results in a non-solid image with poor image properties and other practical disadvantages. This is believed to be due to the characteristics of the melting toner particles during the fusion process in terms of melt, flow, coalescence and adhesion, as well as the coalescence of the individual toner particles to one another during the imaging and fusion processes.

In view of the foregoing, it is one object of this invention to provide an electrostatically imaged printing plate which is capable of high quality and multi-color printing wherein image formation is enhanced due to improved toner melt, toner flow, coalescence and adhesion of the melting toner onto the substrate as well as enhanced coalescence of individual toner particles to each other to form a more solid image. It is another object of this invention to provide a method of preparing such a printing plate. It is yet another object of this invention to provide a method of printing using such a printing plate. It is another object of this invention to provide a method of preparing a printing plate that does not require a chemical development step. Accordingly, the printing plate of this invention is developable "on-press", i.e., development takes place during the printing stage with an aqueous or fountain solution. It is a feature of this invention that the polymer coating employed in this invention advantageously controls the flow of melting toner and enhances image formation. The printing plate of this invention also advantageously may be employed for high quality printing applications such as four-color newspaper printing, book printing, financial and other small format printing, and the like. Other objects, features and advantages of this invention will be apparent to these skilled in the art.

SUMMARY OF THE INVENTION

A printing plate is prepared by a process comprising:

(a) applying a composition comprising at least one polymer to a substrate surface to provide the surface with a water-soluble polymer coating;

(b) imaging the coated substrate with a toner composition comprising toner particles by imagewise applying the toner composition to the polymer coating, wherein the polymer coating has a softening temperature $T_S$;

(c) heating the imaged substrate to a temperature $T_F$ which is equal to or greater than $T_S$; and (d) contacting the imaged substrate with a solution capable of removing the non-imaged portion of the polymer coating, wherein the process does not comprise a chemical development step.

In a preferred embodiment, the substrate is an aluminum substrate having a hydrophilic surface which receives the polymer coating. The polymer composition may be a polyethylene glycol having a molecular weight in the range of 1000–10,000, preferably 2500–6500. The total polymer coating weight is in the range of 0.25–2.0 g/m$^2$, preferably 0.30–1.3 g/m$^2$, more preferably 0.35–0.9 g/m$^2$, most preferably 0.4–0.6 g/m$^2$. The imagewise applied and fused toner is insoluble in the solution used to remove the non-imaged portion of the polymer coating in comparison to the polymer coating itself. The printing plate of this invention is capable of long runs on press with good image quality.

BRIEF DESCRIPTION OF THE DRAWINGS

FIG. 1 schematically depicts the overall process configuration for the preparation of a printing plate in accordance with this invention.

FIG. 2 schematically depicts various process steps and possible mechanisms associated with the preparation and use of a printing plate of this invention.

DETAILED DESCRIPTION OF THE INVENTION

This invention is directed primarily to lithographic printing plates and their preparation and use. Conventional printing plate substrates such as aluminum, polymeric film, and paper may be used as the printing plate substrate in all aspects of this invention. As discussed further herein, it is only necessary that the substrate have a surface capable of accepting at least one water-soluble layer obtained by applying at least one water-soluble polymer coating to the surface. The surface may be a surface of the substrate itself, or a surface of an intermediate coating or layer applied to the underlying substrate surface.

In various preferred embodiments, the printing plate substrate used in this invention may be subjected to treatments such as electrograining, anodization, and silication to enhance its surface characteristics. The surface characteristics that are modified by such treatments are roughness, topology, and the nature and quantity of surface chemical sites.

Exemplary aluminum substrates that can be employed in all aspects of this invention are given in Table 1. Substrates chosen for use in this invention are preferably based on aluminum oxide, and may be subjected to various conventional surface treatments as are well known to those skilled in the art. These treatments also result in different surface roughness, topology, and surface chemical sites, as summarized in Table 1.

TABLE 1

Exemplary Aluminum Substrates for Printing Plate

| Substrate name | Surface Treatment | Interlayer Treatment | Surface Property |
|---|---|---|---|
| AA | Quartz Grained and Anodized | None | Acidic |
| EG-PVPA | Electrograined and Anodized | Polyvinyl phosphoric acid | Acidic |
| PF | Electrograined and Anodized | Sodium dihydrogen phosphate/Sodium fluoride | Acidic |
| G20 | Electrograined and Anodized | Vinylphosphonic acid/acrylamide copolymer | Acidic/ Amphoteric |
| CHB-PVPA | Chemically grained Basic etched | Polyvinyl phosphoric acid | Acidic |
| PG-PVPA | Pumice-grained | Polyvinyl phosphoric acid | Acidic |
| EG-Sil | Electrograined and Anodized | Sodium Silicate | Basic |
| DS-Sil | Chemically Grained and Anodized | Sodium Silicate | Basic |
| PG-Sil | Pumice Grained and Anodized | Sodium Silicate | Basic |
| CHB-Sil | Chemically Grained, Anodized and Silicated | Sodium Silicate | Basic |

"AA" means "quartz grained and anodized." The aluminum surface is first quartz grained and then anodized using DC current of about 8 A/cm$^2$ for 30 seconds in a $H_2SO_4$ solution (280 g/liter) at 30° C.

"EG" means "electrolytic graining." The aluminum surface is first degreased, etched and subjected to a desmut step (removal of reaction products of aluminum and the etchant). The plate is then electrolytically grained using an AC current of 30–60 A/cm$^2$ in a hydrochloric acid solution (10 g/liter) for 30 seconds at 25° C., followed by a post-etching alkaline wash and a desmut step. The grained plate is then anodized using DC current of about 8 A/cm$^2$ for 30 seconds in a $H_2SO_4$ solution (280 g/liter) at 30° C.

"PVPA" is a polyvinylphosphonic acid. The plate is immersed in a PVPA solution and then washed with deionized water and dried at room temperature.

"DS" means "double sided smooth." The aluminum oxide plate is first degreased, etched or chemically grained, and subjected to a desmut step. The smooth plate is then anodized.

"Sil" means the anodized plate is immersed in a sodium silicate solution (80 g/liter), commercially available under the trademark N-38 from the Philadelphia Quartz Co. at 75° C. for one minute. The coated plate is then rinsed with deionized water and dried at room temperature.

"PG" means "pumice grained." The aluminum surface is first degreased, etched and subjected to a desmut step. The plate is then mechanically grained by subjecting it to a 30% pumice slurry at 30° C., followed by a post-etching step and a desmut step. The grained plate is then anodized using DC current of about 8 A/cm$^2$ for 30 seconds in an $H_2SO_4$ solution (280 g/liter) at 30° C. The anodized plate is then coated with an interlayer.

"G20" is a printing plate substrate which is described in U.S. Pat. No. 5,368,974, the disclosure of which is incorporated herein by reference in its entirety.

"CHB" means chemical graining in a basic solution. After an aluminum substrate is subjected to a matte finishing process, a solution of 50 to 100 g/liter NaOH is used during graining at 50 to 70° C. for 1 minute. The grained plate is then anodized using DC current of about 8 A/cm$^2$ for 30 seconds in an $H_2SO_4$ solution (280 g/liter) at 30° C. The anodized plate then coated with a silicated interlayer.

"PF" substrate has a phosphate fluoride interlayer. The process solution contains sodium dihydrogen phosphate and sodium fluoride. The anodized substrate is treated in the solution at 70° C. for a dwell time of 60 seconds, followed by a water rinse, and drying. The deposited dihydrogen phosphate is about 500 mg/m$^2$.

A "basic" surface will have a plurality of basic sites and acidic sites present, with the basic sites predominating to some degree. Similarly, an "acidic" surface will have a plurality of acidic sites and basic sites present, with the acidic sites predominating to some degree. It is known by one of ordinary skill in the art that the PG-Sil printing plate substrate appears to have a higher silicate site density than the DS-Sil printing plate substrate, and is more basic. It is also known that the G20 printing plate substrate exhibits less acidic character than AA printing plate substrates.

In one embodiment of this invention, the substrate has at least one hydrophilic surface. In this embodiment, if the substrate used does not initially have at least one hydrophilic surface, the surface of the substrate may be treated to render it hydrophilic as set forth above with respect to various preferred embodiments. This may be accomplished by methods well known to those skilled in the art. For example, in one preferred embodiment the substrate employed is hydrophilized with PVPA. In another preferred embodiment, the substrate is hydrophilized with silicate. Such hydrophilization of the substrate surface may be accomplished via other techniques well known in the art. In yet another preferred embodiment, a surface of the substrate is first coated with a hydrophilic layer by contacting the substrate surface with a liquid comprising a silicate solution in which particulate material is dispersed, as disclosed, for example, in U.S. Pat. No. 6,105,500, which is incorporated herein by reference in its entirety. As disclosed therein, the silicate solution may comprise one or more, but preferably only one, metal or non-metal silicate. Such metal silicates may be alkali metal silicates, and such non-metal silicates may be quaternary ammonium silicates. The particulate may be an organic or inorganic material. Organic particulate materials may be provided by latexes. Inorganic particulate materials may be selected from alumina, silica, silicon carbide, zinc sulphide, zirconia, barium sulphate, talcs, clays (e.g. kaolin), lithopone and titanium oxide.

The substrate surface is coated with a water-soluble or water-dispersible composition comprising at least one polymer composition component to provide the surface with at least one layer which is water-soluble. The polymer composition may comprise amorphous polymers or crystalline polymers, or combinations thereof.

The polymer coating employed in this invention is characterized by having a softening temperature $T_S$ which is defined herein as the lowest temperature at which the coating sufficiently softens to permit motion of toner particles within the polymer coating. $T_S$ may be determined by ASTM Method D6090–99. The softening temperature $T_S$ must be equal to or less than the temperature $T_F$ at which the toner composition is imagewise applied to the polymer coating (as is further discussed herein). The temperature $T_F$ is the temperature at which the toner-imaged coated substrate is heated to fix or "fuse" the toner to the polymer coating. $T_F$ must be equal to or greater than the glass transition temperature $T_g$ of the toner. If the polymer coating is a crystalline polymer, the polymer melting point $T_M$ as determined, for example, by ASTM Method F 766–82, may be used for the softening temperature $T_S$. If the polymer coating is an amorphous polymer, the polymer glass transition temperature $T_G$ as determined, for example, by ASTM Method El 356–98 may be used for the softening temperature $T_S$.

Without wishing to be bound by any one theory, it is believed that the softening temperature $T_S$ is the lowest temperature which permits the melted toner particles imagewise applied to the polymer coating to flow and reorganize to obtain the optimum "lay down" or application to the substrate as well as the optimum filling of any voids which exist in the toner image and the highest degree of toner interaction with the grain surface of the substrate.

Preferred polymers are homopolymers and copolymers of polyethylene glycol (PEG). In a particularly preferred embodiment, homopolymers of PEG are employed as a polymer component of the water soluble coating. The PEG used has a molecular weight in the range of 1000–10,000, preferably 2500–6500, most preferably 4000–5000. The addition of dispersed particles may also be advantageous, for example, to reduce tackiness of the coating and promote on-press developability. Organic and inorganic particles may be used having particle diameters in the range of 5–1,000 nm, preferably in the range of 10–100 nm, more preferably, 10–50 nm. Particularly preferred are colloidal particles, such as colloidal silica, titania and alumina.

The coating composition may additionally comprise at least one contrast dye. Suitable dyes which optionally may be used in the coating composition are those which are easy to dissolve in the solvent or solvent mixture used in the coating or which can be introduced as pigment in dispersed form. Suitable contrast dyes are, for example, rhodamine dyes, methyl violet, anthraquinone pigments and phthalocyanine dyes or pigments, the series of triarylmethane dyes (such as Victoria Blue BO, Victoria Blue R, crystal violet) or diazo dyes (such as 4-phenylazodiphenylamine, azobenzene or 4-N,N-dimethylaminoazobenzene). Preferably, the dyes are present in the coating composition in an amount of 0.01 to 10 weight %, with about 0.1 to 5 weight % being particularly preferred.

Any suitable solvent for application of the polymer composition known to those skilled in the art may be used in preparing the coating composition. Particularly preferred solvents for use are water, acetone, 2-methoxyethanol (MC), or combinations thereof. Other solvents suitable for use include ethanol, methyl ethyl ketone, toluene, DOWANOL (a product of the Dow Chemical Co.), and water. The choice of solvent is dependent upon the particular components of the coating composition, as will be well understood by those skilled in the art.

After the coating solution is prepared, it may be applied to the substrate surface via methods well known to those skilled in the art, such as in-line hopper coating, bar coating, curtain coating, extrusion coating, pan coating, whirl coating, brushing, spray coating and the like, and dried at temperatures in the range of 40–60° C. The coating, once applied, provides the substrate with a polymer coating which is water-soluble. The coating weight, once applied to the substrate, should be in the range of 0.25–2.0 g/m$^2$, preferably 0.30–1.3 g/m$^2$, more preferably 0.35–0.90 g/m$^2$, most preferably 0.35–0.6 g/m$^2$. If the coating weight is below 0.25 g/m$^2$, there is insufficient coating for enhancement of the toner image. On the other hand, if the coating weight is above 2 g/m , adhesion of the toner is reduced and excessive flow can reduce resolution.

The coated substrate face is imaged using a toner composition, preferably by an electrostatic image technique. As discussed above, electrostatic imaging techniques are well known to those skilled in the art, as exemplified by U.S. Pat. Nos. 3,315,600; 4,444,858; and 6,025,100. For example, the toner composition image may be received by the polymer coating using direct transfer from an OPC drum or belt, or using indirect transfer from a belt or drum that transfers the image from the OPC drum or belt to the polymer coating. It will be understood by those skilled in the art that the purpose of this electrostatic imaging is to transfer the desired image and information contained therein from the information source (e.g. a computer or the like) to the polymer coating residing upon the hydrophilic substrate surface by digital or analog means for inclusion in the printing plate of this invention. In this invention, the polymer coating residing on the substrate acts as a barrier and prevents any contact or physical interaction between the toner composition and the substrate during the imaging process. Toner may also be imagewise applied to the receiving layer by ink jet techniques, as disclosed, for example, in U.S. Pat. No. 5,714,993.

Conventional toner compositions, as are well known in the art, may be used to image the coated substrate face, so long as the toner composition has a glass transition temperature ($T_g$) equal to or lower than the $T_F$ employed in the heating step in this invention. Toner compositions suitable for use in photocopiers, laser printers and the like are suitable for use as the toner composition in the present invention and are preferred. Further information about toner compositions may be found, for example, in U.S. Pat. No. 4,271,249, EP 901045 and EP 898205. In one embodiment of this invention, the toner composition used is photocopier toner comprising carbon black surrounded by a layer of styrene-acrylic or styrene-butadiene resin, and the toner composition has a $T_g$ in the range of 70–90° C. In another preferred embodiment of this invention, cyan toner compositions comprising a PET polymer and having $T_g$ in the range of 75–85° C. are particularly preferred.

After the coated substrate face is imaged, the imaged substrate is heated to a fusing temperature $T_F$ which is equal to or greater than the glass transition temperature $T_g$ of the toner composition. The primary purpose of this heating is to cause the image created by the toner to adhere or fuse to the substrate. For example, this heating may be accomplished by techniques such as contact or non-contact fusing, as are well known to those skilled in the art. Again, the polymer coating enhances the coalescing of the toner composition.

The imaged substrate may thereafter be contacted with an appropriate aqueous solution to remove the non-imaged areas. For example, the polymer coating may be removed from the substrate using an aqueous fountain solution "on press", as will be well understood by those skilled in the art, without further processing (i.e. "process-less"). This procedure does not employ a distinct development step between imaging and printing. Rather, development takes place "on-press" in preferred embodiments, i.e. development takes place during the printing stage, with an aqueous or fountain solution. A preferred developer is the fount solution applied to the printing form at the commencement of printing. Accordingly in one embodiment of this invention there is provided a printing process carried out on a printing plate precursor which has been imaged, the printing process employing a fount solution which effects development by removing areas of the coating which have not been imaged.

Typically actual printing is achieved by placing the imaged printing plate of this invention in a printing press, contacting the plate with a fountain solution and an ink, thereby causing the ink to adhere to the oleophilic imaged portion of the plate, (i.e. the remaining fused toner) and thereafter transferring imagewise the ink from the printing plate to a receiving material such as a rubber blanket or the like, as is well known to those skilled in the art, for eventual transfer of the inked image to newspaper, books or other printed media.

This invention may further be understood by reference to FIGS. 1 and 2, which will be understood by those skilled in the art to be illustrative of various features of this invention. In FIG. 1, an overall schematic of the method of preparing the plate of this invention is provided. The loader 102 loads the substrate having a alkali-soluble, water-soluble or organic solvent-soluble polymer coating residing thereon, into the electrostatic imager 104, which images the coated substrate electrostatically with the toner composition. The imaged plate is thereafter further processed in the fuser 106, where the imaged substrate is heated to a temperature $T_F$ equal to or greater than the $T_g$ of the toner, which is in turn heated to a temperature equal to or greater than $T_S$ of the polymer coating. The imaged substrate may then be further treated to remove the non-imaged portion of the polymer coating or may be transferred from the fuser 106 directly to the press 109. Subsequent to the heating, the imaged substrate (now a printing plate) may be further processed or handled as necessary for installation on the press. For example, the plate may be further processed by a punch and/or bender (not shown) to accommodate the plate for press installation.

In FIG. 2, one embodiment of the method of preparation of the printing plate of this invention (labeled FIGS. 2A through 2D) and possible mechanisms associated with the preparation and use of the printing plate and method of this invention are set forth. As depicted in FIG. 2A, the substrate 202 has a hydrophilic face 204. A polymer coating composition comprising at least one polymer has been applied to the hydrophilic face 204 to provide a polymer coating 206 which is water soluble.

FIG. 2B depicts the printing plate precursor of FIG. 2A after it has been imaged electrostatically with a toner composition to provide a desired toner imaged portion 208. Without wishing to be bound by any one theory, it is believed that the toner imaged portion 208initially adheres or fuses to the polymer coating 206.

FIG. 2C depicts the imaged precursor of FIG. 2B that has been heated to a temperature $T_F$ equal to or greater than the $T_g$ of the toner composition and equal to or greater than the softening temperature $T_S$ of the polymer coating 206. Without wishing to be bound by any one theory, it is believed (as depicted in FIG. 2C) that one mechanism employed in connection with the present invention is that, upon heating of the imaged precursor to a temperature $T_F$, softening or melting of the polymer coating 206 promotes fusion of the toner imaged portion 208.

FIG. 2D depicts the imaged substrate after it has been contacted with or processed using an appropriate aqueous solution. As depicted in FIG. 2D, polymer coating 206 has been removed via contacting with the solution. The desired imaged portion 208 of the toner composition is not removed by contacting with the solution, and resides upon the substrate face 204. The resulting printing plate may be gummed, if desired (not shown) and may be used on press. The plate has enhanced image quality, with good image durability on press.

The invention is exemplified by, but not limited to, the following examples.

EXAMPLE 1

Solutions of 5.0% polyethylene glycol (PEG) in 2-methoxyethanol (MC)/acetone (80:20) were prepared for PEG having molecular weights (MW) of 600,2000 and 10,000. The solutions were then coated onto an aluminum substrate having a hydrophilic surface employing a whirl coater at 70 RPM and dried at 120° F. for three minutes to obtain coating weights in the range of 0.4–0.55 g/m$^2$. The substrate was a pumice-grained silicated plate. Each coated substrate and a blank non-coated control were then imaged on a QMS Magicolor 330 laser printer employing a cyan toner that comprised a PET polymer toner with a $T_g$=81° C. A standard digital target was employed which contained imbedded GATF targets, text writing and a halftone variable dot image at 1200 dpi and 100 lpi. The contact fuser in the engine was disabled and all samples were heated in a radiant oven at 130° C. for 79 seconds.

The images obtained from the plate samples were then observed for comparison. The results are set forth in Table 2.

TABLE 2

| Image Quality | Sample: Blank Control | PEG Coated (MW = 600) | PEG Coated (MW = 2000) | PEG Coated (MW = 10,000) |
|---|---|---|---|---|
| Solidness | 2 | 10 | 9 | 7 |
| Edge Quality | 2 | 9 | 10 | 8 |
| Gloss | 5 | 10 | 10 | 8 |

In Table 2, the following rating system was employed:

1=Poor 5=Good 10=Excellent

The descriptions below further describe the information summarized in Table 2 as follows:

Solidness—A measure of the uniformity of the high density area or the lack of voids in an image.

Edge Quality—A measure of the sharpness and smoothness of the image.

Gloss—A measure of the spectral reflectance of an image, which causes the image to appear shiny.

As set forth in Table 2, it can be seen that the plates prepared using PEG (600 MW) and PEG (2000 MW) exhibited excellent image quality compared to the uncoated blank substrate, and that the plate prepared using PEG (10,000 MW) exhibited very good image quality compared to the uncoated blank substrate.

EXAMPLE 2

Solutions of 3.0% PEG with 0.6 grams of Ludox SM-30 (colloidal silica dispersion available from DuPont) in MC/acetone (80:20) were prepared for a series of polyethylene glycols (PEG) having molecular weights (MW) of 600, 1000, 2000, 3400, 4600, 8000 and 10,000. The solutions were then coated onto a grained aluminum substrate having a hydrophilic surface coating of polyvinyl phosphonic acid. The coatings were made employing a whirl coater at 70 RPM and dried at 120° F. for three minutes to obtain the corresponding coating weights in Table 3 below.

TABLE 3

| | A | B | C | D | E | F | G |
|---|---|---|---|---|---|---|---|
| PEG MW | 600 | 1000 | 2000 | 3400 | 4600 | 8000 | 10000 |
| Coating Weight (g/m$^2$) | 0.47 | 0.47 | 0.50 | 0.49 | 0.56 | 0.58 | 0.48 |

Each coated substrate and a blank non-coated control were then imaged on a QMS Magicolor 330 laser printer employing a black toner that comprised a polyethylene terphthalate (PET) polymer toner with a $T_g$=81° C. A standard digital target was employed which contained imbedded GATF targets, text writing and a halftone variable dot image at 1200 dpi and 100 lpi. The contact fuser in the engine was disabled and all samples were heated in a radiant oven at 130° C. for 79 seconds.

The images obtained from the plate samples were then observed for comparison as in example 1. The image quality, solidness, edge quality and gloss for all experimental coatings was dramatically improved over the blank control as in example 1.

EXAMPLE 3

Solutions were prepared with varying % concentrations of a mixture PEG /Ludox SM-30 (80/20) in MC/acetone (80:20) for a coating weight series study of PEG (MW= 4600) and its effect on image quality and plate tackiness. The solutions were then coated onto a EG-Sil aluminum substrate. The coatings were made employing a whirl coater at 70 RPM and dried at 120° F. for three minutes to obtain the corresponding coating weights in Table 4 below.

TABLE 4

| | A | B | C | D | E | F |
|---|---|---|---|---|---|---|
| PEG/Ludox % | 2 | 3 | 4 | 5 | 7 | 10 |
| Coating Wt (g/m$^2$) | 0.31 | 0.53 | 0.70 | 0.90 | 1.35 | 2.22 |

Each coated substrate and a blank non-coated control were then imaged on a QMS Magicolor 330 laser printer employing a Black toner that comprised a PET polymer toner with a $T_g$=81° C. A standard digital target was employed which contained imbedded GATF targets, text writing and a halftone variable dot image at 1200 dpi and 100 lpi. The contact fuser in the engine was disabled and all samples were heated in a radiant oven at 130° C. for 79 seconds.

The images obtained from the plate samples were then observed for comparison as in example 1 & 2. The image quality, solidness, edge quality and gloss for all experimental coatings was dramatically improved over the blank control for coating weights between 0.31 and 0.90. At higher coating weights we began to see some loss of quality from excessive melting and flow, which worsened with increasing coating weight. Tackiness of the samples, which enhances fingerprinting and blocking of the plates, was also noticable at the high coating weights. The 3% solution, corresponding to a coating weight of 0.53 g/m$^2$, provided the best overall results.

EXAMPLE 4

A classical three level, two factor, full factorial designed experiment was performed and evaluated employing the S-Matrix Card statistical design software. The objective was to prepare samples of on-press developable plates for analysis and optimization. Factor "A" represented the Surfactant: PEG 4600 ratio and Factor "B" represented the percent solids of the coated solution that in turn directly effects the resulting dry coating weight. The surfactant employed was a 50% active Monostat 1195 from Uniqema. All samples were prepared with MC as the solvent and 0.6 g of 30% Ludox SM was added to each sample solution. All plates were prepared on EG-PVPA aluminum substrates, spin coated @ 110 rpm, and dried at 120° F. The primary response variables of concern were the image voids level, adhesion, image quality on the plate, coating weight and the press run length. The design formulations are in Design Table 1.

Design Table 1

| Sample # | Factor A (Surfactant:PEG ratio) | Factor B (% solid content in coated solution) | Coating Weight (g/m$^2$) |
|---|---|---|---|
| 1 | 0.5 | 2 | 0.27 |
| 2 | 0.5 | 2 | 0.34 |
| 3 | 0 | 3 | 0.43 |
| 4 | 0 | 2 | 0.20 |
| 5 | 0 | 1 | 0.16 |
| 6 | 0.5 | 3 | 0.47 |
| 7 | 1 | 2 | 0.27 |
| 8 | 0 | 1 | 0.13 |
| 9 | 1 | 2 | 0.34 |
| 10 | 0.5 | 1 | 0.11 |
| 11 | 1 | 3 | 0.46 |
| 12 | 1 | 1 | 0.10 |

The imaging and toner application was performed in a QMS 330 electrostatic imager with the fusing unit removed so as not to destroy the image on the plate after imaging. The fusing methods employed were the control fusing process performed in a Haupschalter rack oven at 130° C. at a throughput of 96 inches per minute. After fusing the imaged plates were then visually inspected, evaluated. The response data was evaluated employing Design-of-Experiment ("DOE") software, and mathematical regression analysis relationships were obtained. The optimum formulation with respect to the primary response variables is described as follows:

| Variable | Level |
|---|---|
| Ratio of Surfactant to PEG | 0.997 |
| % solid in solution | 2.72 |

-continued

| Variable | Level |
|---|---|
| Post process adhesion | 0.900 |
| Voids level | 1.70 |

This optimum formulation corresponded to a coating weight of 0.41–0.45 g/m$^2$. The range of minimum acceptability for all responses corresponded to a coating weight range of 0.25 g/m$^2$ to 0.45 g/m$^2$. The optimum described by the DOE was coated, imaged and put on press. The plate ran for more than 25,000 impressions with excellent quality.

COMPARATIVE EXAMPLE 1

A 1% solution of polyvinyl alcohol (PVA) (Airvol 107 from Air Products) was prepared by mixing 1.0 g of PVA into 99 g of deionized water while stirring. The mixture was heated to 120° F. for two hr so that the polymer was dissolved. The solution was then used to coat two samples onto PG-sil plate substrate using a #8 wire rod and dried in an oven at 100° F. for 1 hr to achieve a coating weight of about 0.20 g/m$^2$.

Two samples were then imaged on a QMS Magicolor 330 laser printer employing a Black toner that comprised a PET polymer toner with a $T_g$=81° C. A standard digital target was employed which contained imbedded GATF targets, text writing and a halftone variable dot image at 1200 dpi and 100 lpi. The contact fuser in the engine was disabled and one sample was heated in a radiant oven at 140° C. for 20 sec. The second sample was heated in a radiant oven at 140° C. for 20 sec and then heated from the back with a heat gun in order to deliver extreme heating conditions. The samples were then tested for image adhesion (sink rub-up method) and visual quality.

A cloth was pre-dampened with a 5% dilution of Rycoline Seven 434S fountain solution and a small amount of Rub Proof Black US97.1584 press ink was applied to the cloth. Upon lightly wiping the plates with the moistened and inked cloth both fusing conditions exhibited extreme adhesion failure of the image upon application. The rubbing of the plates showed that the image could quickly be removed within 20–30 wipes. Not only was the adhesion very poor but the fused images showed no sign of image enhancement from flow control properties and both samples demonstrated no advantage over non-coated plate stock.

The data show that the process of this invention is superior in both plate visual image quality as well as the quality delivered on press. The improvement in both solid densities delivered on press and in line resolution is not accompanied by a loss of press endurance or performance. This embodiment of the invention delivered high quality images without requiring conventional plate processing or exhibiting the pitfalls of broken lines and non-solid density areas normally observed with electrostatic imaging.

It should be understood that various changes and modifications to the preferred embodiments described herein will be apparent to those skilled in the art. Such changes and modifications can be made without departing from the spirit and scope of this invention and without diminishing its attendant advantages. It is therefore intended that such changes and modifications be covered by the appended claims.

We claim:

1. A printing plate prepared by a process comprising:

(a) applying a coating composition comprising at least one polymer to a substrate surface to provide the surface with a water-soluble or water-dispersible polymer coating;

(b) imaging the coated substrate with a toner composition comprising toner particles by imagewise applying the toner composition to the polymer coating, wherein the polymer coating has a softening temperature $T_S$;

(c) heating the imaged substrate to a temperature $T_F$ which is equal to or greater than $T_S$; and (d) contacting the imaged substrate with a solution capable of removing the non-imaged portion of the polymer coating, wherein the process does not comprise a chemical development step and the polymer coating has a coating weight of about 0.25 to about 2.0 g/m$^2$.

2. The printing plate of claim 1, wherein the coated substrate is imaged electrostatically with the toner composition.

3. The printing plate of claim 1, in which the substrate is aluminum.

4. The printing plate of claim 3, in which the aluminum substrate is hydrophilic.

5. The printing plate of claim 1, in which the polymer is a homopolymer or copolymer of polyethylene glycol.

6. The printing plate of claim 5, in which the polymer is a homopolymer of polyethylene glycol having a molecular weight in the range of 1,000–10,000.

7. The printing plate of claim 6, in which the homopolymer of polyethylene glycol has a molecular weight in the range of 2,500–6,500.

8. The printing plate of claim 1, in which the polymer coating weight is about 0.3 to about 1.3 g/m$^2$.

9. The printing plate of claim 1, wherein the polymer coating further comprises dispersed particles.

10. The printing plate of claim 9, wherein the dispersed particles are selected from colloidal silica, colloidal titania and colloidal alumina particles.

11. A method of preparing a printing plate comprising:

(a) applying a coating composition comprising at least one polymer to a substrate surface to provide the surface with a water-soluble or water-dispersible polymer coating, wherein the polymer coating has a coating weight of about 0.25 to about 2.0 g/m$^2$;

(b) imaging the coated substrate with a toner composition comprising toner particles by imagewise applying the toner composition to the polymer coating, wherein the polymer coating has a softening temperature $T_S$;

(c) heating the imaged substrate to a temperature $T_F$ which is equal to or greater than $T_S$; and (d) contacting the imaged substrate with a solution capable of removing the non-imaged portion of the polymer coating, wherein the method does not comprise a chemical development step.

12. The method of claim 11, wherein the coated substrate is imaged electrostatically with the toner composition.

13. The method of claim 11, in which the polymer is a homopolymer or copolymer of polyethylene glycol.

14. The method of claim 13, in which the polymer is a homopolymer of polyethylene glycol having a molecular weight in the range of 1,000–10,000.

15. The method of claim 14, in which the homopolymer of polyethylene glycol has a molecular weight in the range of 2,500–6,500.

16. The method of claim 11, in which the polymer coating weight is about 0.3 to about 1.3 g/m$^2$.

17. The method of claim 11, wherein the polymer coating further comprises dispersed particles.

18. The method of claim 17, wherein the dispersed particles are selected from colloidal silica, colloidal titania and colloidal alumina particles.

19. A method of printing comprising:

(a) providing a printing plate prepared by a process comprising:

(i) applying a coating composition comprising at least one polymer to a substrate surface to provide the surface with a water-soluble or water-dispersible polymer coating, wherein the polymer coating has a coating weight of about 0.25 to about 2.0 g/m$^2$;

(ii) imaging the coated substrate with a toner composition comprising toner particles by imagewise applying the toner composition to the polymer coating, wherein the polymer coating has a softening temperature Ts, (iii) heating the imaged substrate to a temperature $T_F$ which is equal to or greater than Ts, and (iv) contacting the imaged substrate with a solution capable of removing the non-imaged portion of the polymer coating without a chemical development step;

(b) contacting the imaged printing plate with an ink; and (c) transferring imagewise the ink from the printing plate to a receiving material.

20. The method of claim 19, wherein the coated substrate is imaged electrostatically with the toner composition.

21. The method of claim 19, in which the polymer coating weight is about 0.3 to about 1.3 g/m$^2$.

22. A printing plate comprising image areas of toner fused at a fusing temperature $T_F$ overlying a water-soluble or dispersible polymer coating, wherein the polymer coating has a coating weight of about 0.25–2.0 g/m$^2$ and a softening temperature $T_S$ which is equal to or less than the fusing temperature $T_F$.

23. The printing plate of claim 22, in which the polymer is a homopolymer or copolymer of polyethylene glycol.

24. The printing plate of claim 23 in which the polymer is a homopolymer of polyethylene glycol having a molecular weight in the range of 1,000–10,000.

25. The printing plate of claim 24, in which the homopolymer of polyethylene glycol has a molecular weight in the range of 2,500–6,500.

26. The printing plate of claim 22, in which the polymer coating weight is about 0.3 to about 1.3 gm$^2$.

27. The printing plate of claim 22, wherein the polymer coating further comprises dispersed particles.

28. The printing plate of claim 27, wherein the dispersed particles are selected from colloidal silica, colloidal titania and colloidal alumina particles.

29. The method of claim 11 wherein the solution capable of removing the non-imaged portion of the polymer coating comprises a fountain solution.

30. The method of claim 11 wherein the contacting step occurs on-press.

* * * * *

UNITED STATES PATENT AND TRADEMARK OFFICE

CERTIFICATE OF CORRECTION

PATENT NO. : 6,670,084 B2
DATED : December 30, 2003
INVENTOR(S) : Patrick R. Friedman et al.

It is certified that error appears in the above-identified patent and that said Letters Patent is hereby corrected as shown below:

Title page,
Item [75], Inventor, delete "LaPorte" and insert therefor -- LaPotre --

Signed and Sealed this

Thirteenth Day of April, 2004

JON W. DUDAS
*Acting Director of the United States Patent and Trademark Office*